US007533773B2

(12) United States Patent
Aldridge et al.

(10) Patent No.: US 7,533,773 B2
(45) Date of Patent: May 19, 2009

(54) RECLOSABLE CONSUMABLE PRODUCT PACKAGE ASSEMBLY

(75) Inventors: Allen Sydney Aldridge, South Orange, NJ (US); Charles F. Flynn, IV, Oak Ridge, NJ (US); James S. Mandle, Lake Luzerne, NY (US)

(73) Assignee: Cadbury Adams LLC, Parsippany, NJ (US)

( * ) Notice: Subject to any disclaimer, the term of this patent is extended or adjusted under 35 U.S.C. 154(b) by 528 days.

(21) Appl. No.: 11/175,014

(22) Filed: Jul. 5, 2005

(65) Prior Publication Data

US 2006/0027483 A1 Feb. 9, 2006

Related U.S. Application Data

(60) Provisional application No. 60/586,355, filed on Jul. 8, 2004, provisional application No. 60/688,605, filed on Jun. 8, 2005.

(51) Int. Cl.
*B65D 25/54* (2006.01)

(52) U.S. Cl. ..... 206/738; 206/766; 206/774; 206/460

(58) Field of Classification Search ..... 206/460, 206/268, 800, 738, 526, 813, 766, 774; 229/160.1, 229/87.05, 232; 426/5, 115
See application file for complete search history.

(56) References Cited

U.S. PATENT DOCUMENTS

| | | | |
|---|---|---|---|
| 183,466 | A | 10/1876 | Pearl |
| 271,580 | A | 1/1883 | Jones |
| 276,171 | A | 4/1883 | Fraser |
| 329,134 | A | 10/1885 | Brotz |
| 528,186 | A | 10/1894 | Strakosch |
| 603,872 | A | 5/1898 | Bucklin |
| 624,583 | A | 5/1899 | Vierengel |
| 656,349 | A | 8/1900 | Hilson |
| 924,275 | A | 6/1909 | Richardson |
| 1,037,218 | A | 9/1912 | Dirnberger |
| 1,096,909 | A | 5/1914 | Harvey |
| 1,132,781 | A | 3/1915 | Lile |
| 1,144,559 | A | 6/1915 | Mendelson et al. |
| 1,193,423 | A | 8/1916 | Pryor |

(Continued)

FOREIGN PATENT DOCUMENTS

| | | |
|---|---|---|
| BE | 417615 | 10/1936 |

(Continued)

OTHER PUBLICATIONS

Mr. Brown Chewing Gum, Product Description, p. 1, http://www.gnpd.com, Feb. 7, 2000.

*Primary Examiner*—David T Fidei
(74) *Attorney, Agent, or Firm*—Hoffmann & Baron, LLP

(57) ABSTRACT

The present invention provides a reclosable consumable product package for retaining an array of products until the products are desired to be removed. The package includes a container packet formed of a planar extent roll for retaining and enclosing the array of products. A cover with adhesive attached thereto defined by an openable flap overlies the packet. The packet is scored along its surface in such a way that opening of the flap causes the packet to open along the scoring to expose the product for dispensing.

20 Claims, 13 Drawing Sheets

U.S. PATENT DOCUMENTS

| | | | |
|---|---|---|---|
| 1,216,259 | A | 2/1917 | Armstrong |
| 1,253,219 | A | 1/1918 | Dula |
| 1,275,904 | A | 8/1918 | Grotta |
| 1,320,287 | A | 10/1919 | Stern |
| 1,382,459 | A | 6/1921 | Bercovici |
| 1,432,932 | A | 10/1922 | Weis |
| 1,433,439 | A | 10/1922 | Weis |
| 1,469,080 | A | 9/1923 | Goerk |
| 1,490,529 | A | 4/1924 | Dittgen |
| 1,550,966 | A | 8/1925 | Kappes |
| 1,575,420 | A | 3/1926 | Eisenstark et al. |
| 1,625,651 | A | 4/1927 | Gretsch |
| 1,683,651 | A | 9/1928 | Bovard |
| 1,684,381 | A | 9/1928 | Bahr |
| 1,735,325 | A | 11/1929 | L'enfant |
| 1,751,208 | A | 3/1930 | Kappes |
| 1,755,579 | A | 4/1930 | Grupe |
| 1,763,763 | A | 7/1930 | Denmead |
| 1,805,417 | A | 5/1931 | Ritzel |
| 1,805,418 | A | 5/1931 | Ritzel |
| 1,806,905 | A | 5/1931 | Kampfman |
| 1,824,491 | A | 9/1931 | Molins |
| 1,854,849 | A | 4/1932 | Lerch |
| 1,863,190 | A | 6/1932 | Coulapides |
| 1,864,493 | A | 6/1932 | Bombard et al. |
| 1,865,535 | A | 7/1932 | Meany |
| 1,870,299 | A | 8/1932 | Strelitz |
| 1,871,426 | A | 8/1932 | Schmitt |
| 1,875,197 | A | 8/1932 | Molins |
| 1,895,233 | A | 1/1933 | Rossen |
| 1,906,742 | A | 5/1933 | Coulapides |
| 1,929,148 | A | 10/1933 | Molins et al. |
| 2,008,168 | A | 7/1935 | Bergstein |
| 2,008,361 | A | 7/1935 | Lindsey |
| 2,031,011 | A | 2/1936 | Solon |
| 2,032,661 | A | 3/1936 | Linker |
| 2,039,491 | A | 5/1936 | Nolan |
| 2,042,073 | A | 5/1936 | Rose |
| 2,049,124 | A | 7/1936 | Linderman |
| 2,074,451 | A | 3/1937 | Berberian |
| 2,085,728 | A | 7/1937 | Clark |
| 2,117,281 | A | 5/1938 | Bravi |
| 2,118,849 | A | 5/1938 | Lindsey |
| 2,128,843 | A | 8/1938 | Mullins |
| 2,140,748 | A | 12/1938 | Johanson |
| 2,158,971 | A | 5/1939 | Stratton |
| 2,165,539 | A | 7/1939 | Dahlgren |
| 2,192,472 | A | 3/1940 | Huston |
| 2,192,473 | A | 3/1940 | Huston |
| 2,197,219 | A | 4/1940 | Gorshong |
| 2,201,956 | A | 5/1940 | Little |
| 2,208,229 | A | 7/1940 | Ranney |
| 2,210,194 | A | 8/1940 | Baldwin |
| 2,210,195 | A | 8/1940 | Baldwin |
| 2,210,196 | A | 8/1940 | Baldwin |
| 2,212,773 | A | 8/1940 | Gray |
| 2,251,102 | A | 7/1941 | Atterberg |
| 2,263,191 | A | 11/1941 | Saladin et al. |
| 2,268,379 | A | 12/1941 | Bird et al. |
| 2,276,577 | A | 3/1942 | Hahn |
| 2,277,097 | A | 3/1942 | Hansen |
| 2,298,028 | A | 7/1942 | Manko |
| 2,327,301 | A | 8/1943 | David |
| 2,343,222 | A | 2/1944 | Nelson |
| 2,379,934 | A | 7/1945 | Seiferth |
| 2,380,367 | A | 7/1945 | Ranny |
| 2,470,388 | A | 5/1949 | Ball |
| 2,547,779 | A | 4/1951 | Renyck |
| 2,563,689 | A | 8/1951 | Muhlhauser |
| 2,578,583 | A | 12/1951 | O'Brien |
| 2,605,897 | A | 8/1952 | Rundle |
| 2,619,092 | A | 11/1952 | Ayers |
| 2,619,226 | A | 11/1952 | Adams |
| 2,682,475 | A | 6/1954 | Smith |
| 2,719,663 | A | 10/1955 | Meyer-Jagenberg |
| 2,744,624 | A | 5/1956 | Hoogstoel et al. |
| 2,755,918 | A | 7/1956 | Gargagliano |
| 2,799,441 | A | 7/1957 | Nerney |
| 2,801,002 | A | 7/1957 | Volckening et al. |
| 2,803,376 | A | 8/1957 | Kampff |
| 2,812,057 | A | 11/1957 | Brownfield |
| 2,820,545 | A | 1/1958 | Bramhill |
| 2,823,798 | A | 2/1958 | Volckening et al. |
| 2,858,060 | A | 10/1958 | Küchler |
| 2,871,080 | A | 1/1959 | Shelly |
| 2,883,045 | A | 4/1959 | Abramson |
| 2,923,110 | A | 2/1960 | Tamari |
| 2,933,182 | A | 4/1960 | Davis |
| 2,954,116 | A | 9/1960 | Maso et al. |
| 2,962,161 | A | 11/1960 | Lacy |
| 2,988,209 | A | 6/1961 | Parrilla |
| 3,002,674 | A | 10/1961 | Wright |
| 3,027,998 | A | 4/1962 | Ridgway |
| 3,035,756 | A | 5/1962 | Mullinix |
| 3,047,144 | A | 7/1962 | Wissel |
| 3,071,244 | A | 1/1963 | Doran |
| 3,092,501 | A | 6/1963 | Beck et al. |
| 3,108,711 | A | 10/1963 | Anton |
| 3,113,673 | A | 12/1963 | Stein |
| 3,118,588 | A | 1/1964 | Noble |
| 3,152,694 | A | 10/1964 | Nashed et al. |
| 3,165,249 | A | 1/1965 | Peck |
| 3,187,889 | A | 6/1965 | Sinclair |
| 3,201,258 | A | 8/1965 | Mastella |
| 3,201,536 | A | 8/1965 | Fisher et al. |
| 3,204,759 | A | 9/1965 | Palmer |
| 3,206,094 | A | 9/1965 | Humphrey et al. |
| 3,224,922 | A | 12/1965 | Straight |
| 3,272,423 | A | 9/1966 | Bjarno |
| 3,282,413 | A | 11/1966 | Sparks |
| 3,322,323 | A | 5/1967 | Greene et al. |
| 3,323,643 | A | 6/1967 | Rush |
| 3,367,552 | A | 2/1968 | Krzyanowski |
| 3,374,884 | A | 3/1968 | Chinkes |
| 3,389,784 | A | 6/1968 | Hendricks et al. |
| 3,389,852 | A | 6/1968 | Egli |
| 3,438,565 | A | 4/1969 | Lugt et al. |
| 3,509,989 | A | 5/1970 | Woll |
| 3,524,583 | A | 8/1970 | Gregory |
| 3,542,191 | A | 11/1970 | Scott |
| 3,580,466 | A | 5/1971 | Thelen |
| 3,583,358 | A | 6/1971 | Hanson, Jr. |
| 3,591,071 | A | 7/1971 | Rosenburg, Jr. |
| 3,623,653 | A | 11/1971 | Work |
| 3,642,564 | A | 2/1972 | Walker et al. |
| 3,664,572 | A | 5/1972 | Puchkoff et al. |
| 3,708,946 | A | 1/1973 | Cahill |
| 3,732,663 | A | 5/1973 | Geldmacher |
| 3,734,280 | A | 5/1973 | Amneus et al. |
| 3,734,801 | A | 5/1973 | Sebel |
| 3,756,385 | A | 9/1973 | Steinbock |
| 3,835,989 | A | 9/1974 | Mori et al. |
| 3,881,649 | A | 5/1975 | Krautsack |
| 3,923,239 | A | 12/1975 | Lee |
| 3,924,739 | A | 12/1975 | Gravesteijn |
| 3,938,655 | A | 2/1976 | Romolt |
| 3,966,045 | A | 6/1976 | Perdue |
| 3,991,168 | A | 11/1976 | Richards et al. |
| 4,015,770 | A | 4/1977 | Tamarin |
| 4,053,049 | A | 10/1977 | Beauvais |
| 4,101,024 | A | 7/1978 | Furuya et al. |
| 4,119,196 | A | 10/1978 | Flaherty |
| 4,125,189 | A | 11/1978 | Fujimoto et al. |
| 4,131,195 | A | 12/1978 | Worrell, Sr. |

| | | | |
|---|---|---|---|
| D250,748 | S | 1/1979 | Leger |
| 4,142,635 | A | 3/1979 | Capo et al. |
| 4,192,420 | A | 3/1980 | Worrell, Sr. et al. |
| 4,197,949 | A | 4/1980 | Carlsson |
| 4,216,898 | A | 8/1980 | Davies |
| 4,234,084 | A | 11/1980 | Hutten |
| 4,260,061 | A | 4/1981 | Jacobs |
| RE30,616 | E | 5/1981 | Hofer |
| 4,294,353 | A | 10/1981 | Focke et al. |
| 4,360,106 | A | 11/1982 | Irvine et al. |
| 4,377,235 | A | 3/1983 | Carver |
| 4,411,365 | A | 10/1983 | Horikawa et al. |
| 4,436,205 | A | 3/1984 | Horii |
| 4,441,611 | A | 4/1984 | Sommariva |
| 4,464,154 | A | 8/1984 | Ljungcrantz |
| 4,470,508 | A | 9/1984 | Yen |
| 4,546,875 | A | 10/1985 | Zweber |
| 4,552,269 | A | 11/1985 | Chang |
| 4,610,357 | A | 9/1986 | Nakamura |
| 4,637,544 | A | 1/1987 | Quercetti |
| 4,658,963 | A | 4/1987 | Jud |
| 4,666,040 | A | 5/1987 | Murata |
| 4,679,693 | A | 7/1987 | Forman |
| 4,738,359 | A | 4/1988 | Phillips, Jr. |
| 4,850,482 | A | 7/1989 | Campbell |
| 4,874,096 | A | 10/1989 | Tessera-Chiesa |
| 4,902,142 | A | 2/1990 | Lammert et al. |
| 4,949,841 | A | 8/1990 | Focke et al. |
| 4,961,496 | A | 10/1990 | Focke et al. |
| 4,997,082 | A | 3/1991 | Durocher |
| 5,029,712 | A | 7/1991 | O'Brien et al. |
| 5,078,509 | A | 1/1992 | Center et al. |
| 5,080,227 | A | 1/1992 | Focke |
| 5,092,465 | A | 3/1992 | Weder et al. |
| 5,096,113 | A | 3/1992 | Focke |
| 5,123,589 | A | 6/1992 | Cote |
| 5,125,211 | A | 6/1992 | O'Brien |
| 5,128,157 | A | 7/1992 | Ruiz |
| 5,150,720 | A | 9/1992 | Focke et al. |
| 5,192,386 | A | 3/1993 | Moir et al. |
| 5,195,637 | A | 3/1993 | Weder |
| 5,215,249 | A | 6/1993 | Gorrieri |
| 5,240,109 | A | 8/1993 | Weder et al. |
| 5,255,784 | A | 10/1993 | Weder et al. |
| 5,290,616 | A | 3/1994 | Cowan et al. |
| 5,301,804 | A | 4/1994 | Focke et al. |
| 5,307,988 | A | 5/1994 | Focke et al. |
| 5,311,992 | A | 5/1994 | Weder et al. |
| 5,316,211 | A | 5/1994 | Chang |
| 5,344,008 | A | 9/1994 | DeBlasio et al. |
| D351,104 | S | 10/1994 | Kapp |
| 5,358,171 | A | 10/1994 | Focke |
| 5,407,072 | A | 4/1995 | Weder et al. |
| 5,435,439 | A | 7/1995 | Swart |
| 5,462,223 | A | 10/1995 | Focke et al. |
| D365,023 | S | 12/1995 | Abrams et al. |
| 5,489,060 | A | 2/1996 | Godard |
| 5,510,124 | A | 4/1996 | Kopecky et al. |
| 5,511,658 | A | 4/1996 | Focke et al. |
| 5,515,965 | A | 5/1996 | Boldrini et al. |
| 5,522,205 | A | 6/1996 | Weder |
| 5,553,773 | A | 9/1996 | Focke et al. |
| 5,556,026 | A | 9/1996 | Blankitny |
| 5,560,482 | A | 10/1996 | Katagiri et al. |
| 5,575,385 | A | 11/1996 | Zona |
| 5,607,056 | A | 3/1997 | Whiteside |
| 5,620,550 | A | 4/1997 | Andersson et al. |
| 5,632,378 | A | 5/1997 | Provost |
| 5,636,732 | A | 6/1997 | Gilels et al. |
| 5,732,823 | A | 3/1998 | Weder et al. |
| 5,738,207 | A | 4/1998 | Trimani |
| 5,783,266 | A | 7/1998 | Gehrke |
| 5,797,494 | A | 8/1998 | Balling et al. |
| 5,823,331 | A | 10/1998 | Manservigi et al. |
| 5,836,448 | A | 11/1998 | Weder |
| 5,855,434 | A | 1/1999 | Hagen |
| 5,860,524 | A | 1/1999 | Weder |
| 5,860,526 | A | 1/1999 | Burke, Jr. |
| 5,878,883 | A | 3/1999 | Weder |
| 5,941,641 | A | 8/1999 | Kinigakis et al. |
| 5,944,188 | A | 8/1999 | Grosskopf et al. |
| 5,992,621 | A | 11/1999 | Grant et al. |
| 5,996,797 | A * | 12/1999 | Flaig ..... 206/494 |
| 6,001,397 | A | 12/1999 | Boyd et al. |
| 6,010,724 | A | 1/2000 | Boyd et al. |
| 6,026,953 | A | 2/2000 | Nakamura et al. |
| D421,568 | S | 3/2000 | Ferguson et al. |
| 6,044,848 | A | 4/2000 | Huang |
| 6,094,917 | A | 8/2000 | Sundhar et al. |
| 6,105,856 | A | 8/2000 | Kakiuchi |
| 6,164,444 | A | 12/2000 | Bray et al. |
| 6,199,687 | B1 | 3/2001 | Tambo et al. |
| 6,202,838 | B1 | 3/2001 | Tran |
| 6,220,430 | B1 | 4/2001 | Boriana et al. |
| 6,228,450 | B1 | 5/2001 | Pedrini |
| 6,237,760 | B1 | 5/2001 | Parker et al. |
| 6,309,105 | B1 | 10/2001 | Palumbo |
| 6,334,532 | B1 | 1/2002 | Tambo et al. |
| 6,395,317 | B1 | 5/2002 | Singh et al. |
| D465,416 | S | 11/2002 | Dzwill et al. |
| 6,478,149 | B1 | 11/2002 | Parker |
| 6,505,735 | B1 | 1/2003 | Parker |
| D471,804 | S | 3/2003 | Staples |
| D479,464 | S | 9/2003 | Kopecky |
| D479,646 | S | 9/2003 | Overton |
| 6,644,488 | B1 | 11/2003 | Coleman |
| D484,046 | S | 12/2003 | Kopecky |
| 6,709,684 | B2 | 3/2004 | Loth |
| 7,032,754 | B2 * | 4/2006 | Kopecky ..... 206/460 |
| 2002/0063079 | A1 | 5/2002 | Loth |
| 2003/0034255 | A1 | 2/2003 | Luton et al. |
| 2003/0047470 | A1 | 3/2003 | Parker |
| 2003/0080020 | A1 | 5/2003 | Kopecky |
| 2003/0106928 | A1 | 6/2003 | Li Vigni et al. |
| 2005/0276525 | A1 | 12/2005 | Hebert et al. |

FOREIGN PATENT DOCUMENTS

| | | |
|---|---|---|
| DE | 653242 | 11/1937 |
| DE | 9405638 | 6/1994 |
| DE | 10238905 | 3/2004 |
| EP | 0 801 000 | 10/1997 |
| FR | 762011 | 4/1934 |
| FR | 1204079 | 1/1960 |
| GB | 2 074 532 | 11/1981 |
| GB | 2078202 | 1/1982 |
| GB | 2227221 | 7/1990 |
| JP | 2-138584 | 11/1990 |
| JP | 07-099891 | 4/1995 |
| JP | 11-1221 | 1/1999 |
| JP | 11-001220 | 6/1999 |
| WO | WO 01/07335 | 2/2001 |
| WO | WO 03/037744 | 5/2003 |

* cited by examiner

RECLOSABLE CONSUMABLE PRODUCT PACKAGE ASSEMBLY

CROSS-REFERENCE TO RELATED APPLICATIONS

This application claims priority to U.S. Provisional Application No. 60/586,355, filed Jul. 8, 2004; and U.S. Provisional Application No. 60/688,605, filed Jun. 8, 2005; which are incorporated herein by reference.

FIELD OF THE INVENTION

The present invention relates generally to a package for containing an array of consumable products and retaining the products in the package until such time as the individual products are desired to be removed. Particularly, the present invention relates to a package assembly for providing reclosable covering for a package of individually wrapped gum slabs.

BACKGROUND OF THE INVENTION

Certain consumable products such as sticks or slabs of chewing gum may be housed in a package where the gum slabs are arranged in an array which allows for ease of dispensing an individual slab therefrom. The gum slabs may be individually wrapped so that a wrapped gum slab may be individually removed from the array in the package. Removal of one of the gum slabs creates a space in the array which allows the adjacent gum slabs become displaced. It may become difficult to remove additional gum slabs from the package especially if one or more of the gum slabs tilts or falls over within the package. Also, the remaining slabs may slide or move around in the package and may even fall out of the package.

Examples of commercially available dispensing package used to store products such as gum slabs are shown in U.S. Pat. No. 5,632,378 to Provost and U.S. Pat. No. 5,797,494 to Balling et al. Both Provost and Balling et al. show a package formed by a wrapper wrapped around a plurality of stacked products such as chewing gum. The wrapper includes a tear open upper end to expose the gum slabs for removal. An adhesive is applied to the bottom surface of the wrapper to hold the gum slabs releasably in the interior of the package after the wrapper is opened.

Some other examples include U.S. Pat. No. 5,125,211 and U.S. Pat. No. 5,029,712, both to O'Brien et al. which shows a reclosure stick gum package being a container having a front portion, top end portion and back portion. An adhesive front label is applied to the front portion of the container. A flexible adhesive flap is then applied which covers the label, top end, and back portions of the container. The flap also includes a non-adhesive pull tab. By lifting the pull tab the front portion is detached which removes the top end to open the package with back of flap remaining attached. The flap is resealable to the front portion of the package, to allow the package to be reclosed.

Furthermore U.S. Pat. No. 1,751,208 to Kappes describes a confection or gum package including an inner wrapper with series of corrugations to securely retain gum pieces such that when one piece is removed, the remaining pieces will not be dislodged and fall out. The package also includes an outer wrapper wrapped around the package to retain the inner wrapper in its original corrugated form as to prevent its own displacement from the package.

As presented by the above examples, a need exists to provide a product package which includes a container packet for containing an array of slabs with an additional reclosable covering so that when the package is opened, only a portion of the container packet is opened for consumer to remove the desired product while the remaining gum slabs are retained in the packet.

SUMMARY OF THE INVENTION

The present invention provides a reclosable consumable product package assembly having a plurality of consumable products. The package includes a container packet for retaining and enclosing the products. The packet defines opposed major planar surfaces, opposed top and bottom surfaces, and opposed end surfaces. A cover overlies the opposed major surfaces and the opposed top and bottom surfaces of the product and is adhesively attached thereto. The cover defines an openable flap overlying the top surface and at least a portion of one major surface. The packet is scored along one of the major surface and the top surface such that opening of the flap causes the packet to open along the scoring to expose the products for dispensing. Adhesive may be employed for retaining the individual slabs in the packet.

The package assembly may support the consumable products in an aligned face-to-face array. Also, the package assembly may support the product in two vertically arranged rows of side-by-side arrays.

DETAILED DESCRIPTION OF THE PREFERRED EMBODIMENT

Figure 1A:
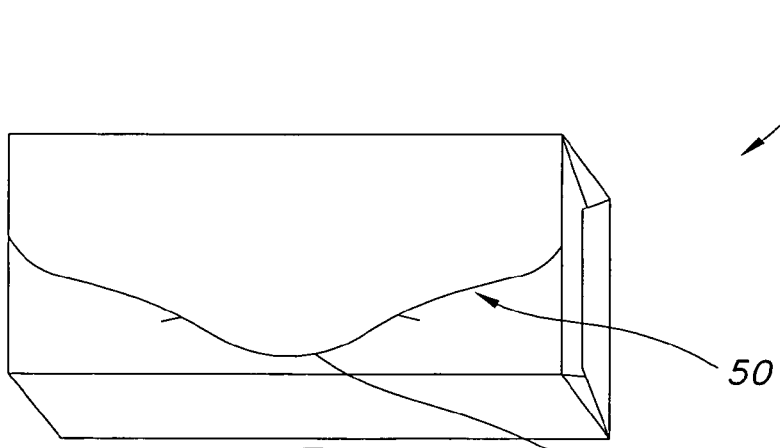
FIGS. 1A-1C show, in perspective, a reclosable package assembly of the present invention in the closed, open and reclosed condition, respectively.
Figure 1B:
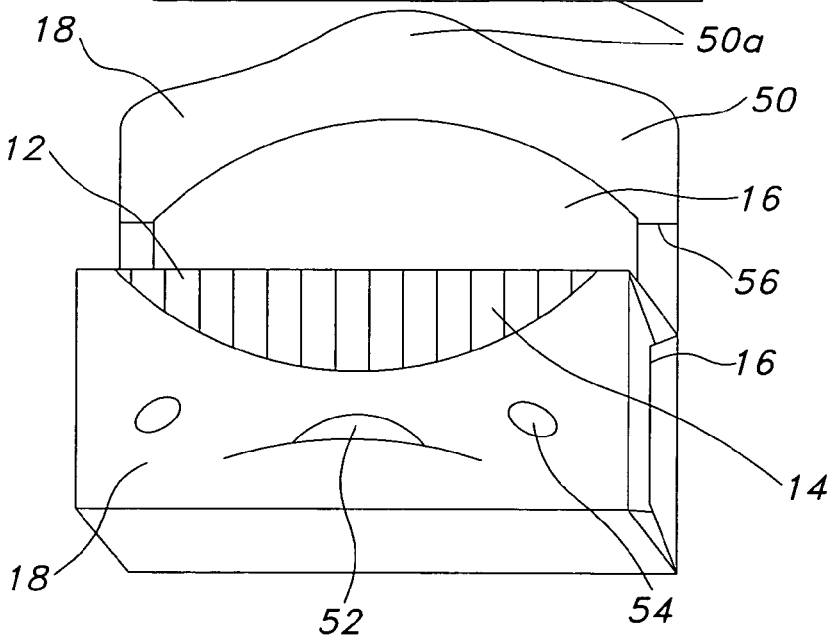
Figure 1C:
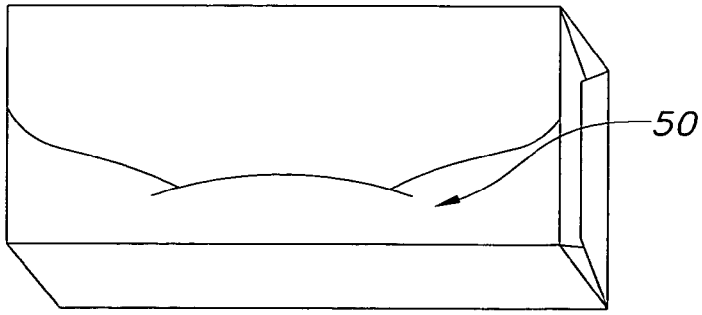

The present invention provides a reclosable consumable product package assembly 10 having an array 12 of gum slabs 14 as shown in FIGS. 1A-1C. While gum slabs 14 are shown in the preferred embodiment of the present invention, other consumable products may be employed. The package assembly 10 also includes a container packet 16 which retains and encloses the array 12 of gum slabs 14 as will be described hereinbelow. Additionally, a cover 18 overlies and is secured to the container packet 16 as will be described further below.

Figure 2A:
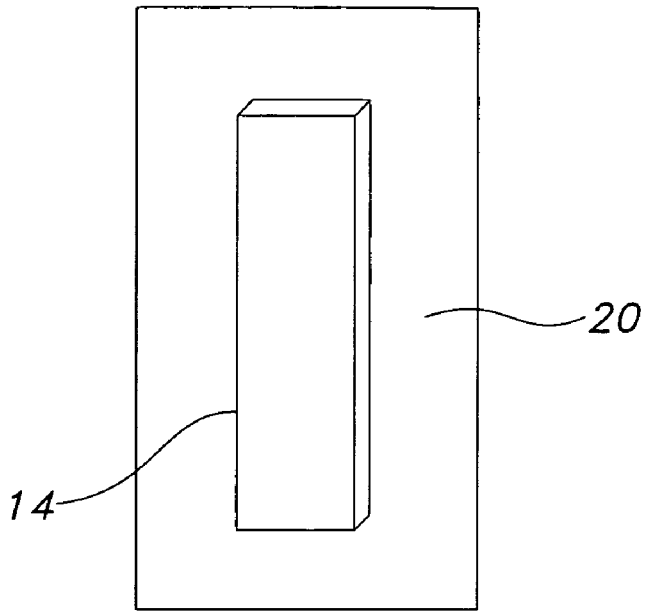
FIGS. 2A and 2B show a wrapper for wrapping individual gum slabs in the open and wrapped condition, respectively.
Figure 2B:
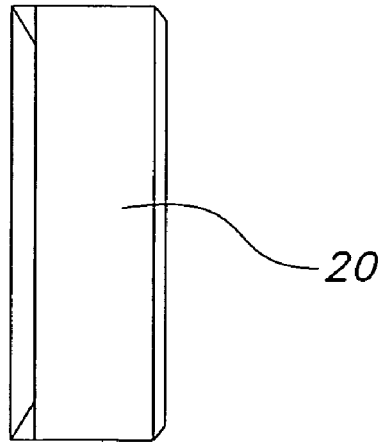

Gum slabs 14 are typically elongate rectangularly shaped members which are individually wrapped with an inner wrapper 20 in a conventional fashion as shown in FIG. 2A. The inner wrapper 20 is a rectangular shaped member preferably made of bleached tissue paper. Typically, the longitudinal edges of the inner wrapper 20 are overlapped and the ends of which are turned over against the slab 10 enclosing the same thereby completely wrapping the gum slab 14 as shown in FIG. 2B.

As discussed above, the gum slabs 14 are shown to be individually wrapped prior to being placed in the container packet 16. The wrapper 20 may be a single sheet or may include plural sheets or layers. However, it is noted that the gum slabs 14 can be placed in an array 10 directly into the packet 16, without being individually wrapped.

Figure 3A:
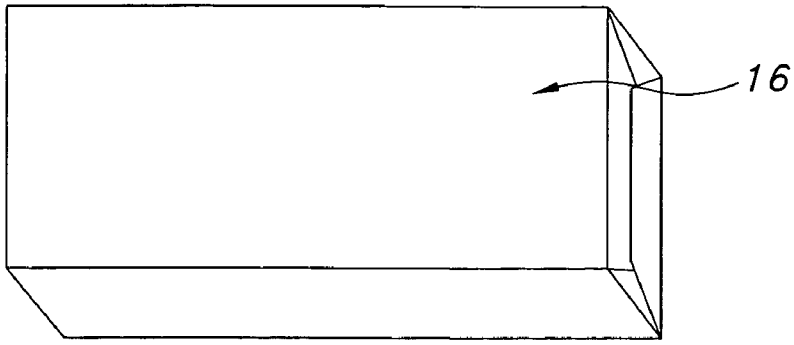
FIG. 3A-3C show the container packet for wrapping the array of gum slabs shown in the closed, partially open, and fully open conditions respectively.
Figure 3B:
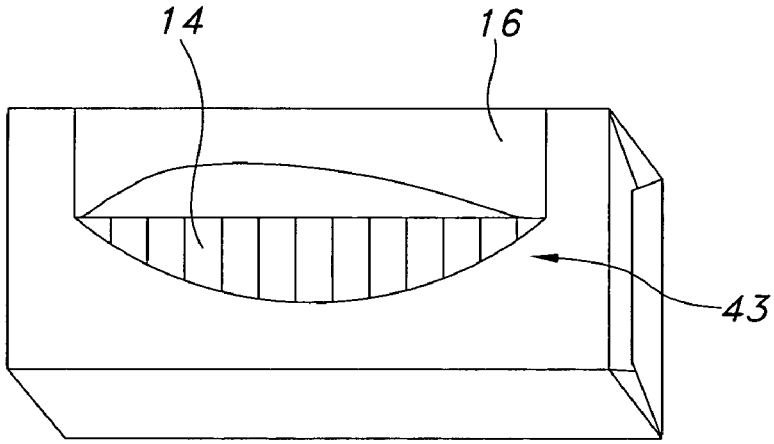
Figure 3C:
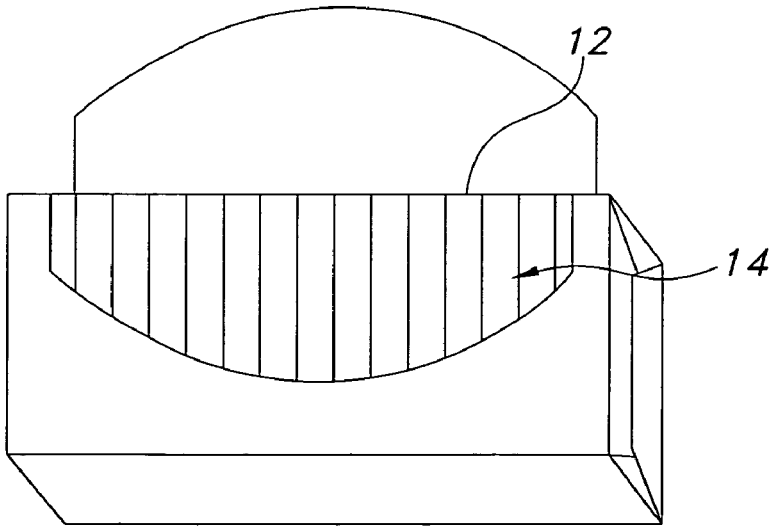

In the present embodiment, each of the wrapped gum slabs 14 are placed in a face-to-face fashion to form the array 12. The array 12 of gum slabs 14 is placed in the container packet 16 to retain and enclose the array 12 of gum slabs 14 as shown in FIGS. 3A-3C.

Figure 4A:
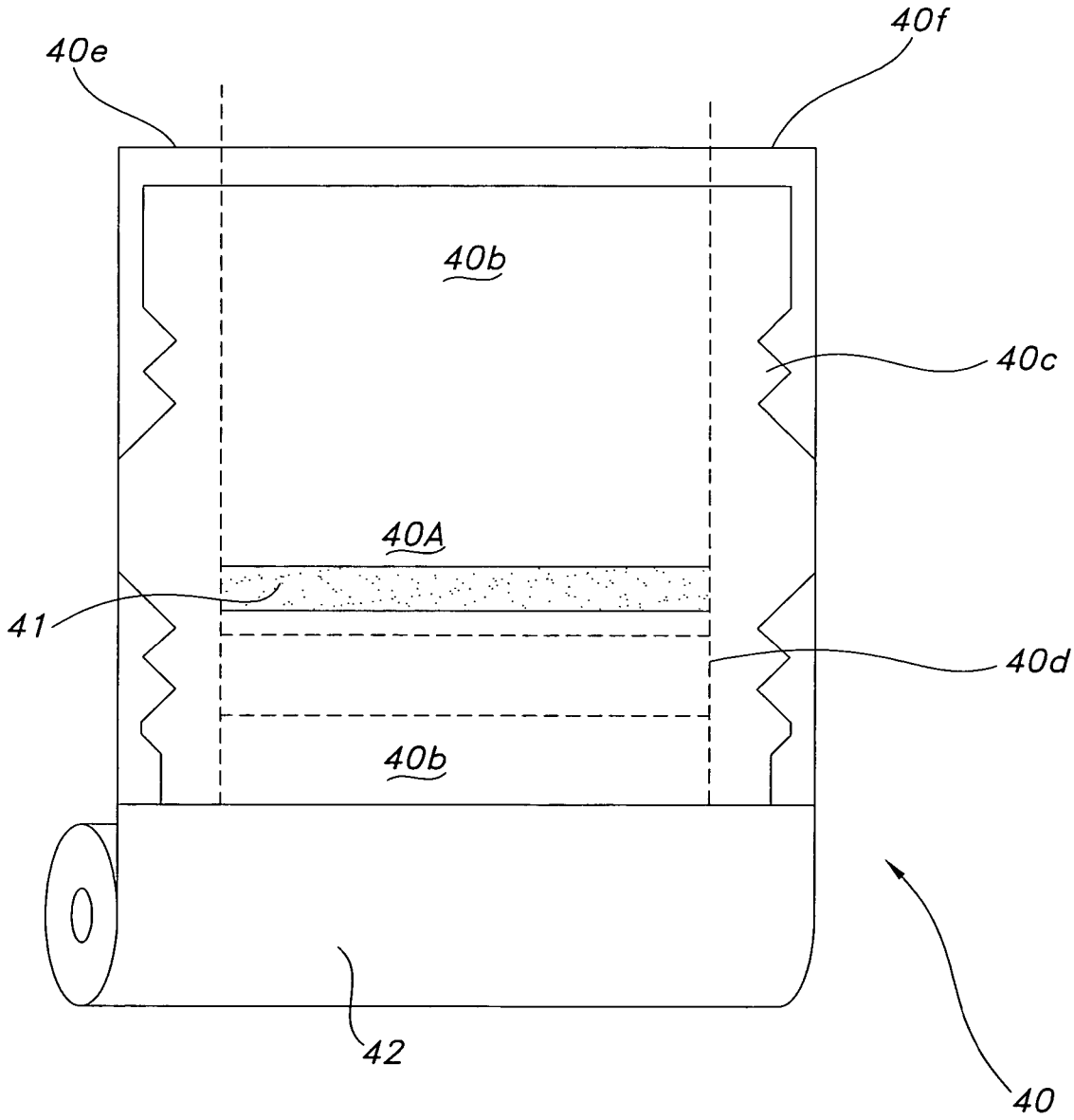
FIGS. 4A and 4B show a material used to form the wrapper of FIG. 3 formed from a roll in a flat configuration.
Figure 4B:
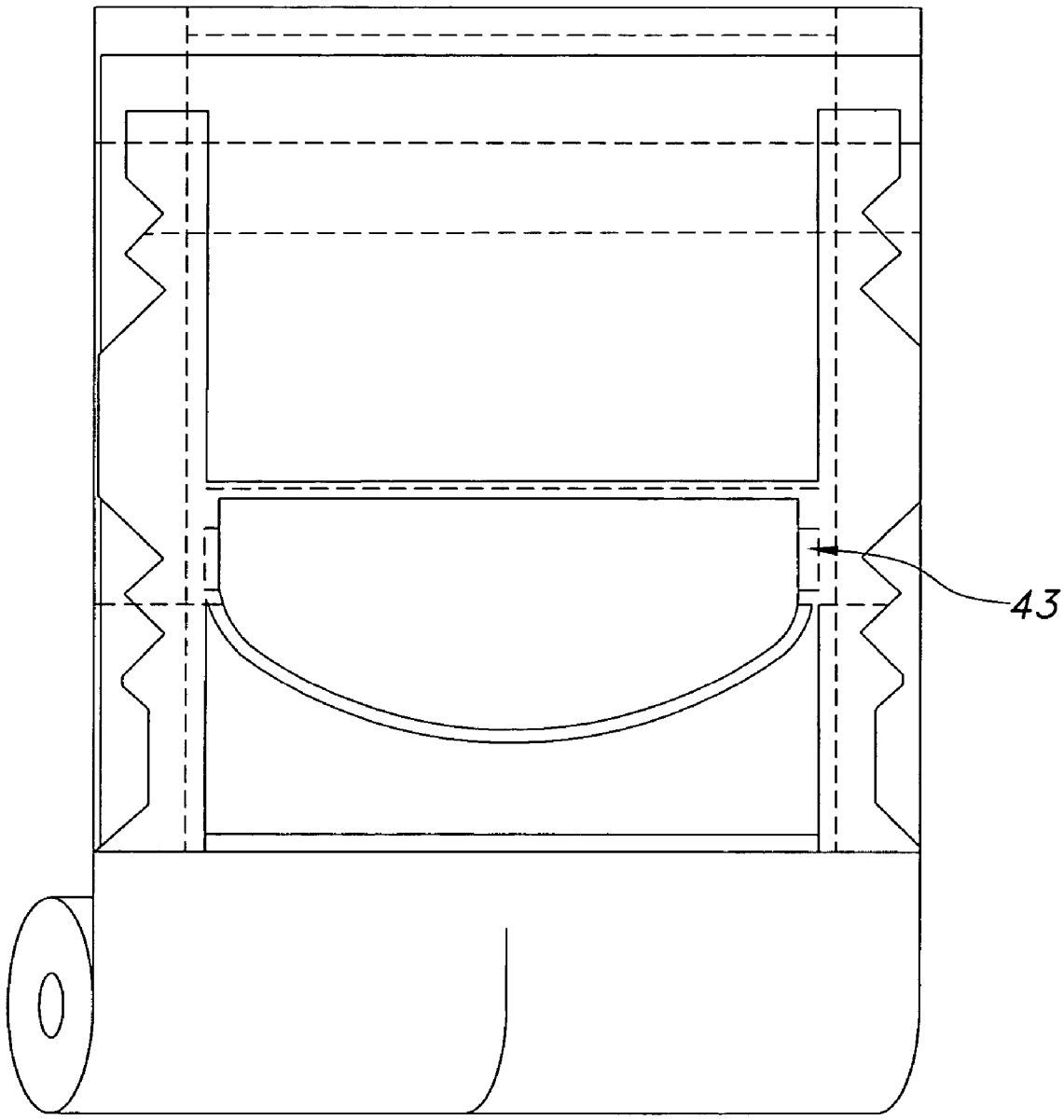

In a preferred embodiment of the present invention, the container packet 16 is made of a planar extent 40 cut from a roll 42 which is preferably formed from both paper and foil wrap, as shown in FIGS. 4A and 4B. The extent 40 includes an adhesive which is a flood coating of hot melt. This flood coating covers the entire paper surface of extent 40. The adhesive is activated by heating the extent 40 along a line or strip that runs transversely across the full length. This adhesive strip 41 engages each of the gun slabs 14 so that when the packet is formed, the gum slabs 14 are adhesively retained in the packet 16. Such adhesive retention allows the gum slabs to remain positioned in the package even upon removal of one or more gum slabs therefrom. Such adhesive attachment prevents the gum slabs from becoming inadvertently dislodged from the package or falling over.

As shown by the lines in FIG. 4A, extent 40 is folded to form the packet 16. The extent 40 is folded so as to define opposed front and back planar surface 40*a* and 40*b*, top and bottom surfaces 40*c* and 40*d*, back end surfaces 40*e* and 40*f*. The end surfaces 40*e* and 40*f* are folded in conventional fashion to form the ends packet 16. The total width of the roll 40 is preferably about 102 mm out of which about 10 mm each is used at opposed ends 40*c* and 40*d* for folding the same.

As shown in FIG. 4B, the extent 40 is scored, preferably laser scored beginning from about 15 mm from the edge of the extent 40. The laser scoring 43 as shown in FIG. 3A is defined as a "smile cut" on the paper side of the extent 40, but not through the foil side of the extent 40.

The depth of the laser cut may be controlled to provide such precision cutting. As the packet 16 provides extent 42 environmental protection for the slabs, the packet remains intact even with the laser cut.

The planar extent 40 of FIGS. 4A and 4B is folded to enclose the array 10 of slabs 12 to form the container packet 16 as shown in FIGS. 3A-3C. Again, the packet 16 in FIG. 3, is a combination of foil and paper with laser perforated on paper side only with the foil side out as shown in FIG. 3A. As seen in FIG. 3B, the "smile cut" shape 43 is scored on the paper side of the packet 16 leaving the foil environmental barrier in place. So, upon lifting the packet 16, it lifts up the foil to cause a tear to occur along the laser perforation. The tear causes the packet 16 to be opened. As seen in FIG. 3C, the array 12 of the gum slabs 14 are held in place until the consumer pulls on the gum slab 14 thereby releasing the adhesive 41 (FIG. 4A) which bonds the gum slabs 14 in place.

Figure 5:
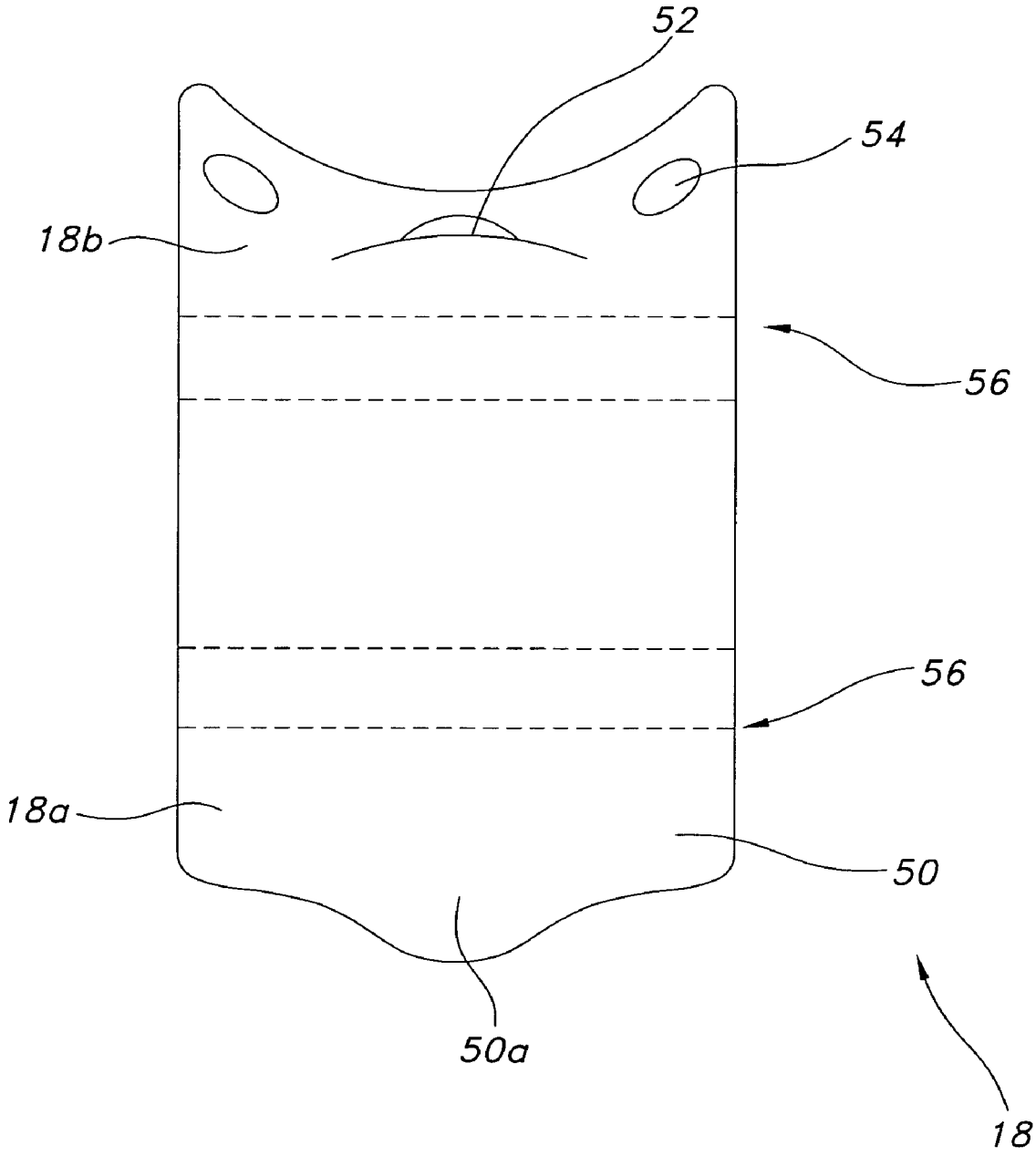
FIG. 5 shows a cover of the assembly of FIG. 1 in a flat condition.
Figure 6:
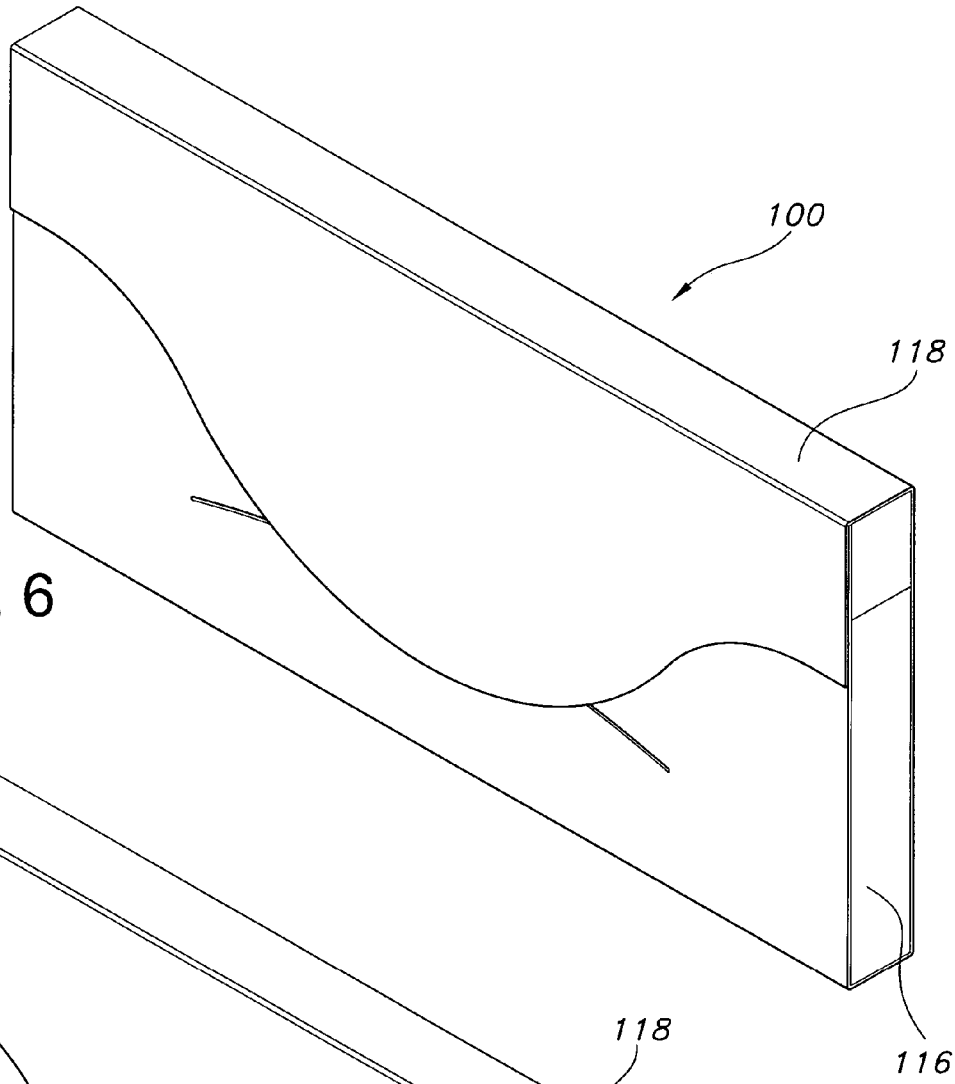
FIGS. 6-11 show a further embodiment of the reclosable package assembly of the present invention.
Figure 7:
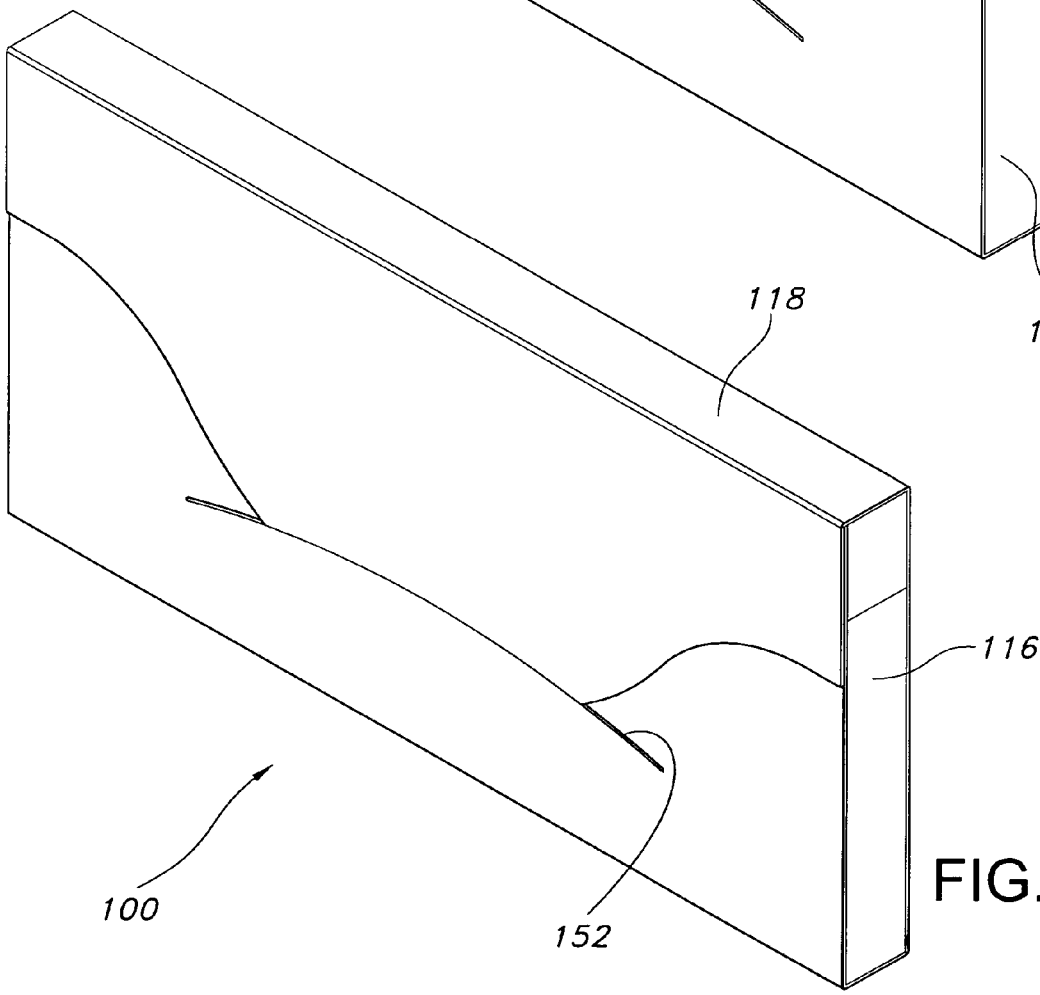
Figure 8:
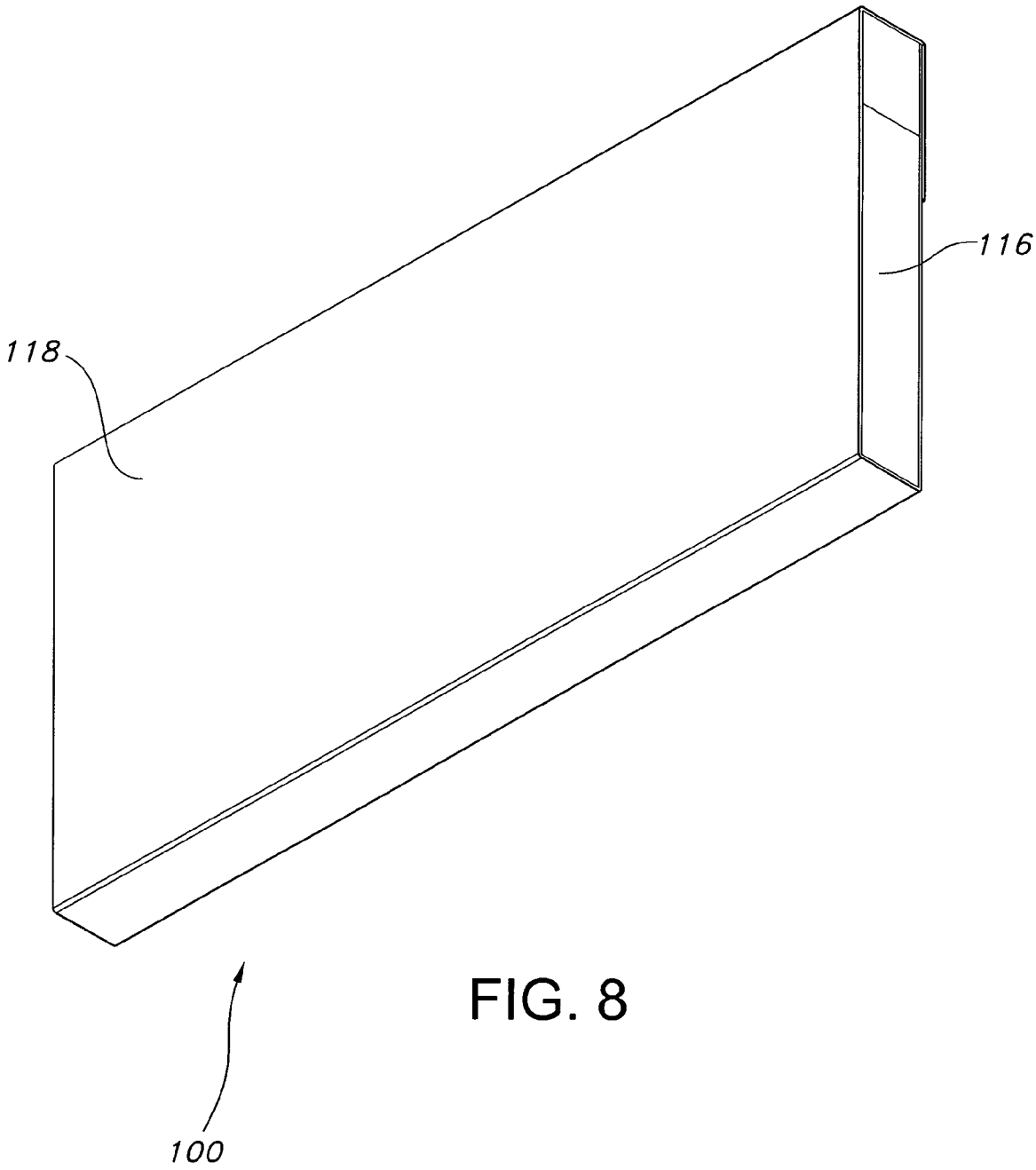

Referring to FIG. 5 of the present invention, there is shown a cover 18 preferably made of paperboard consisting of printed label. The cover 18 specifically overlies and is secured to the packet 16 as shown in FIGS. 1A-1C. The cover 18 is coextensive with major surfaces of the packet 16. One end 18*a* of the cover 18 defines an openable flap 50 which overlies the front of the packet 16 as shown in FIG. 1A. The other end 18*b* of the cover 18 overlies and is adhesively secured to the front surface of the packet 16 as shown in FIG. 1B. The other end 18*b* of the cover 18 includes a slot 52 preferably at the center and oval shaped dots 54 of adhesive on each side as shown in FIG. 5 and FIG. 1B for additional securement of the enclosed assembly 10. The flap 50 includes a tab 50*a* at its top edge as shown in FIG. 5. The tab 50*a* inserts or tucks into the slot 52 covering the packet 18 as shown in FIG. 1C. Additionally, as shown in FIG. 5, the cover 18 is scored along the top and bottom surfaces such that opening of the flap 50 causes the packet 18 to be opened along the scoring 56, thereby revealing the array 12 of gum slabs 14 for dispensing as seen in FIG. 1B.

The use of the reclosable product package assembly 10 with reference to FIGS. 1A-1C is described herein. FIG. 1A shows the enclosed package assembly 10 prior to use with the flap 50 bonded to the adhesive dots 54. When the consumer opens the assembly 10 by pulling up the tab 50*a* of the flap 50, the bonding between the flap 50 and the adhesive dots 54 is broken. Further, by opening the flap, so causes the foil portion of the packet 16 to tear along the laser scoring 43 leaving the array 12 of the gum slabs 14 accessible. As discussed above, the slabs 14 are attached to the inside of the bottom surface, i.e., the foil portion of the packet 16 with an adhesive to keep them from falling over as the package 10 is opened. The consumer may pull out as many gum slabs 14 as needed. Finally, the consumer will simply pull the flap 50 downward and tuck the tab 50*a* into the slot 52 to close the package assembly 10.

Figure 9:
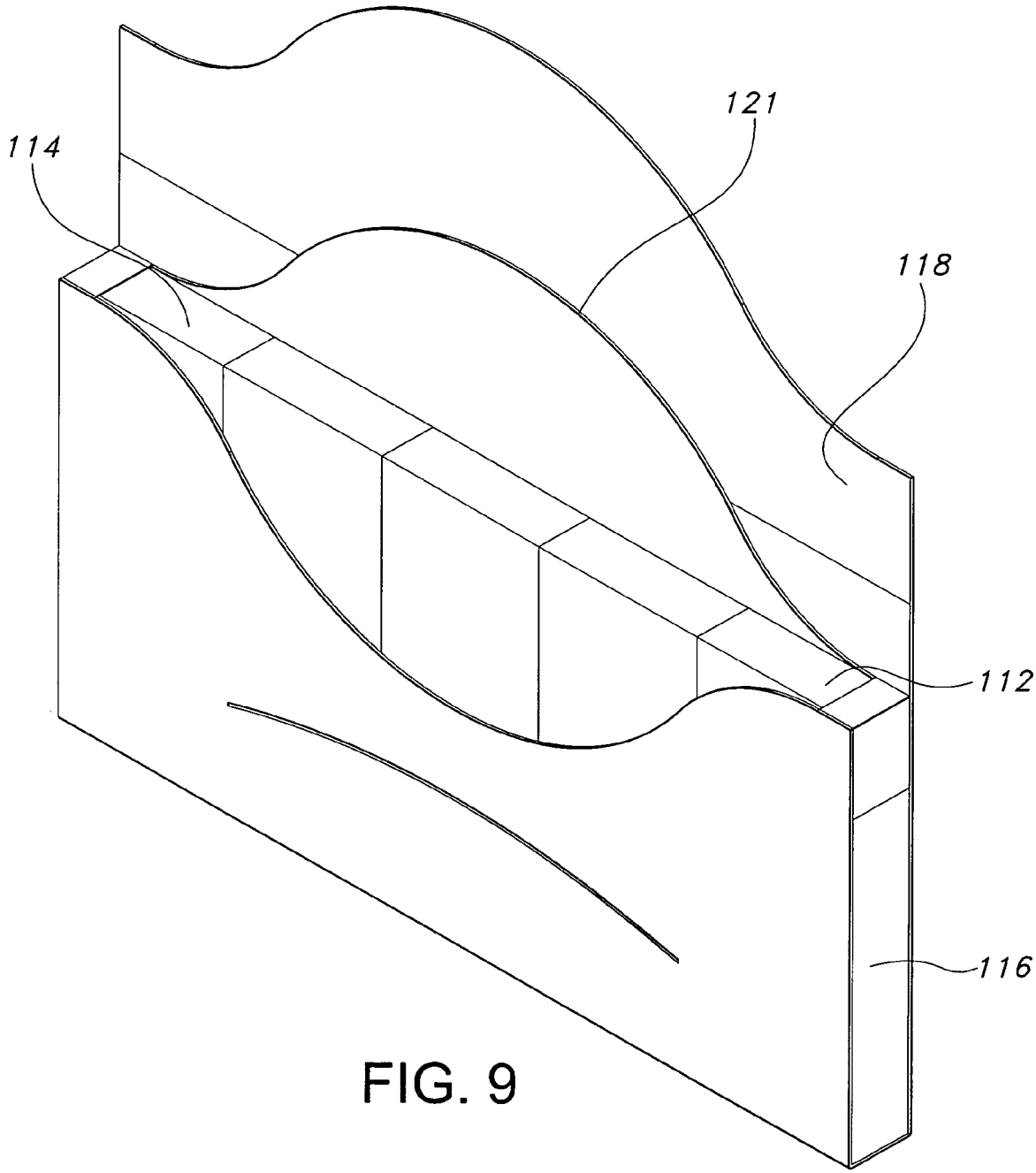

A further embodiment of the reclosable package of the present invention is shown with respect to FIGS. 6-11. The embodiment shown in FIGS. 6-11 is substantially similar to the embodiment shown above and may be formed in substantially the same fashion. The product package assembly 100 includes an array 112 of gum slabs 114 (FIG. 9). Gum slabs 114 of the present embodiment are wider and thicker gum slabs and the arrangement is such that the product package assembly 110 is smaller than product package assembly 10 in FIGS. 1A-1C so that lesser gum slabs 114 are supported within the package.

Figure 11:
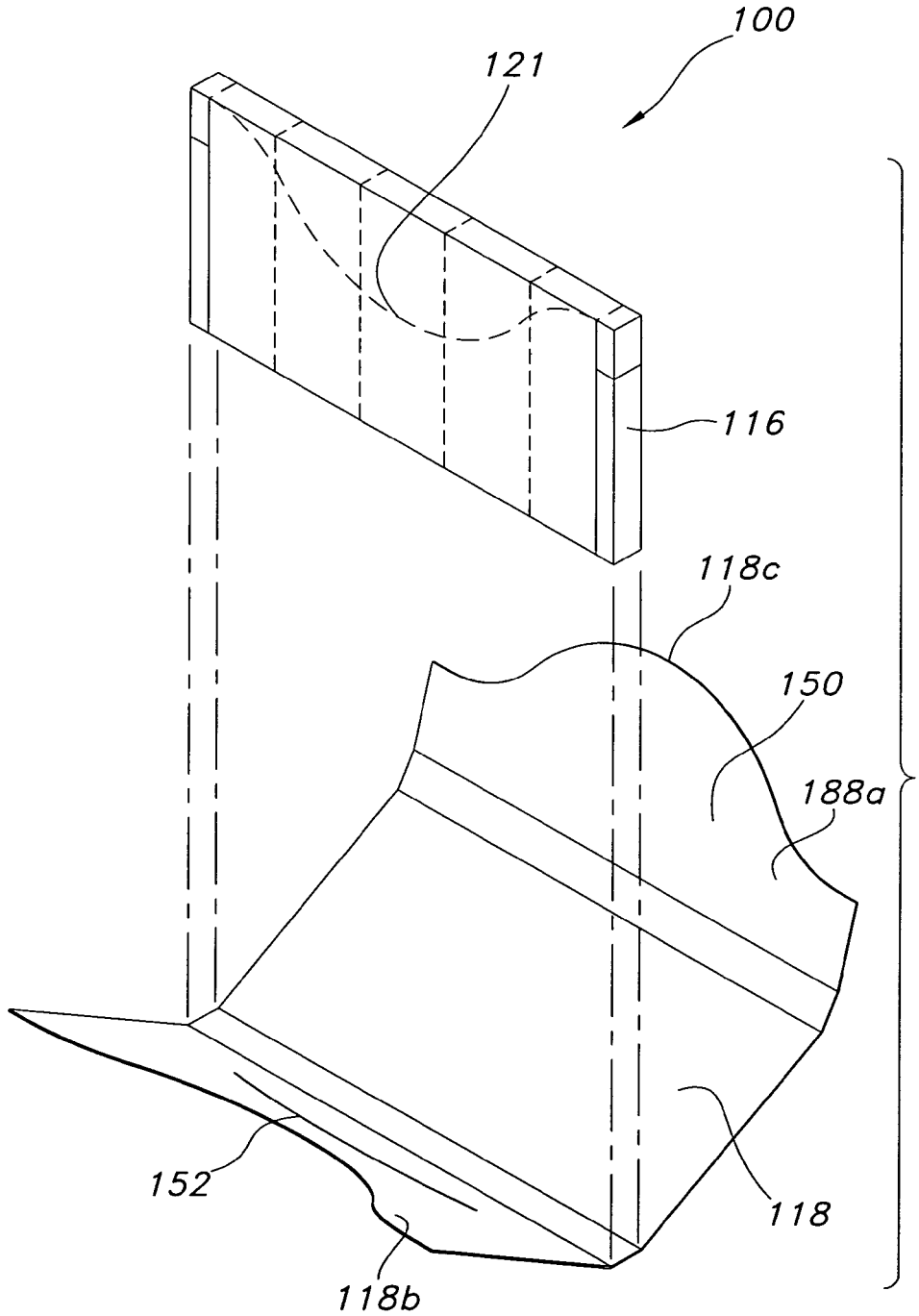

Referring additionally to FIGS. 9 and 11, as with the above embodiment, package assembly 110 includes a container packet 116 which retains and encloses the array 112 of gum slabs 114. A cover 118 overlies and is secured to the container packet 116. The gum slabs 114 may include an individual wrapping or may be provided without such a wrapping.

The container packet 116 is made of a paper/foil composite structure and may include an adhesive coating on one surface to retain the gum slabs 114 therein. The packet is formed from a planar sheet (not shown herein) and folded to define an enclosure about slabs 114.

The packet 116 is scored preferably by laser scoring to define a smile cut 121 which extends through the paper portion of packet 116 but not through the foil portion.

Figure 10:
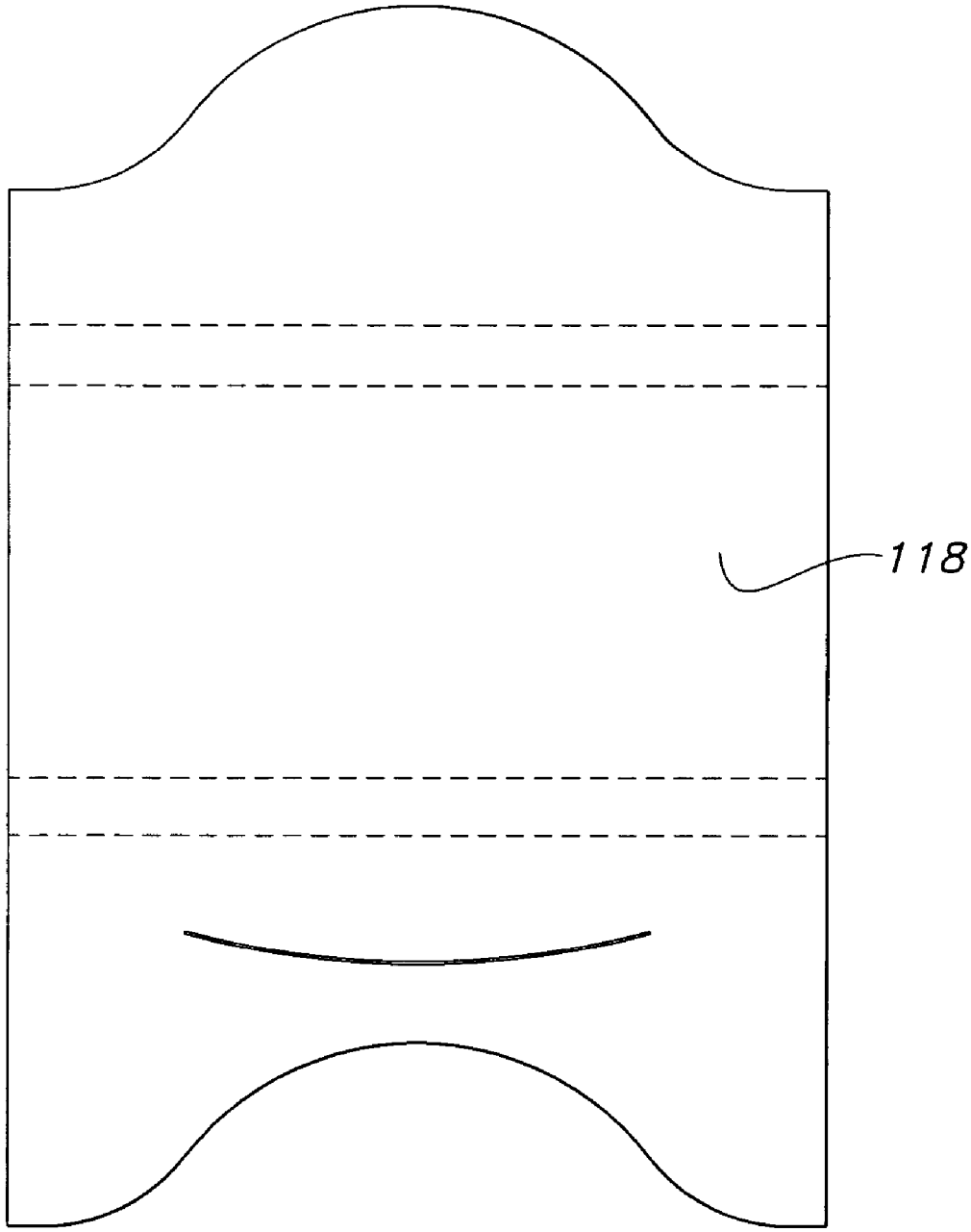

Cover 118, more fully shown in FIGS. 10 and 11, is preferably made of paper or paperboard and may include a printed label. The cover 118 overlies and is secured to the packet 116. End 118*a* includes a tab 118*c*. One end 118*a* of cover 118 defines an openable flap 150 which overlies the front of the packet 116. The other end 118*b* of cover 118 overlies and is adhesively secured to the opposed surface of packet 116. The other end 118*b* of cover 118 includes a slot 152 for reclosable securement of the cover. The tab 118*c* of end 118*a* is insertable into slot 152.

Reclosable product package assembly 110 of the present embodiment may be employed in a manner similar to that described above with respect to the FIG. 1 embodiment. When the consumer opens the assembly 110 by pulling up flap 150, the package is open. Further opening the flap causes the foil portion of the packet to tear along the laser scored smile cut 121 opening the packet 116 and exposing the gum slabs for removal. To close the package assembly 110, the consumer will pull the flap downward and tuck the tab 118*c* of the flap into the slot 152 and close the assembly.

Figure 12:
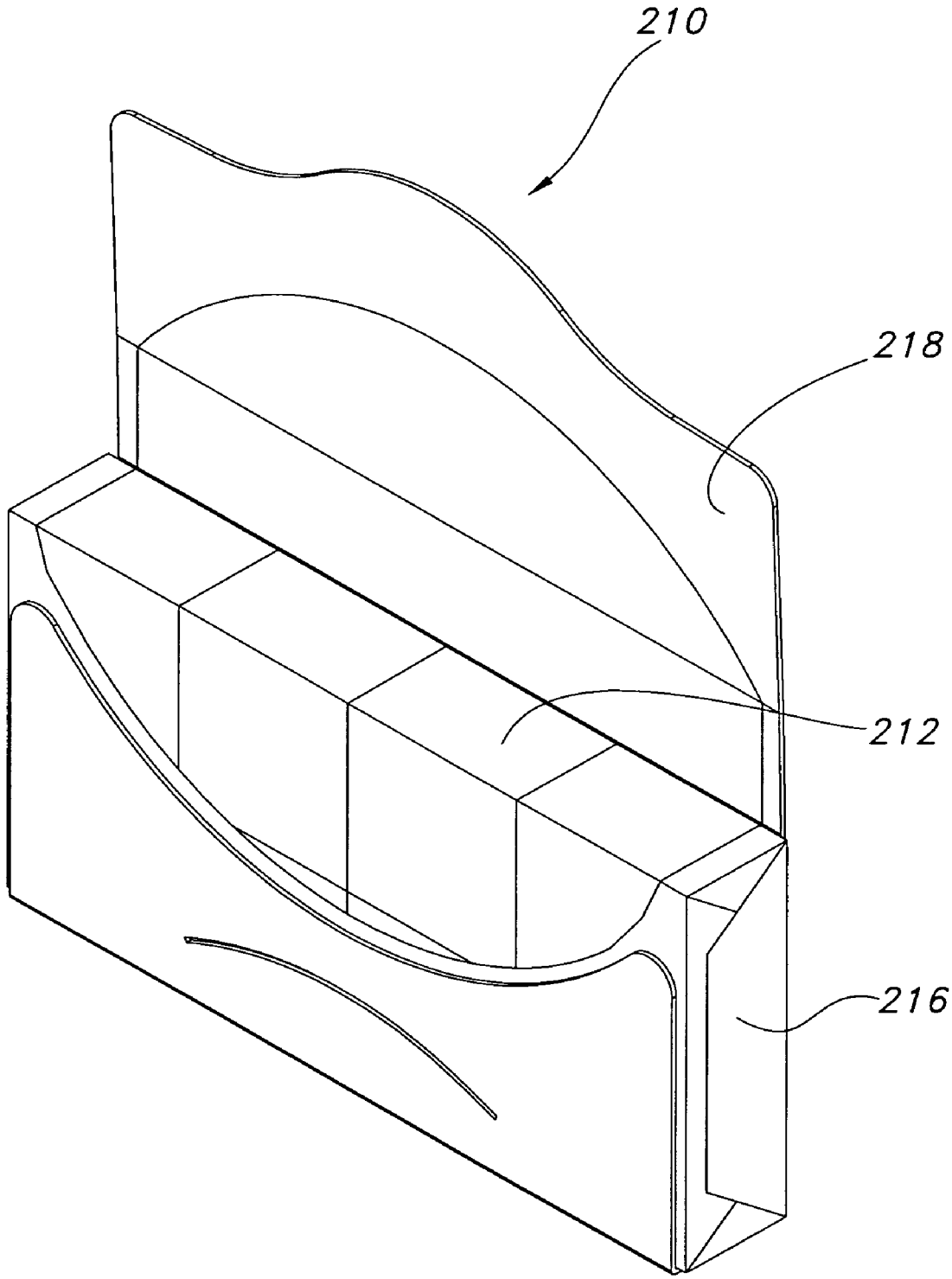
FIG. 12 shows a further embodiment of the reclosable package assembly of the present invention shown in the open condition.

A further embodiment of the present invention is shown with respect to FIG. 12. Package assembly 210 is substantially similar to the package assembly as described above with respect to the previous figures and operates in a similar manner.

With respect to the present illustrative embodiment, the package is wider and shorter than the previous package inasmuch as instead of gum slabs being supported in a single side-by-side array, pillow-shaped gum pieces 212 are shown. The pillow-shaped gum pieces 212 have a square front face and are arranged in two side-by-side arrays in a vertically stacked relationship. The packet 216 and the cover 218, which are substantially similar to those described above, are sized to support this arrangement. The packet and the cover are constructed and operate in a manner similar to that described above.

Figure 13:
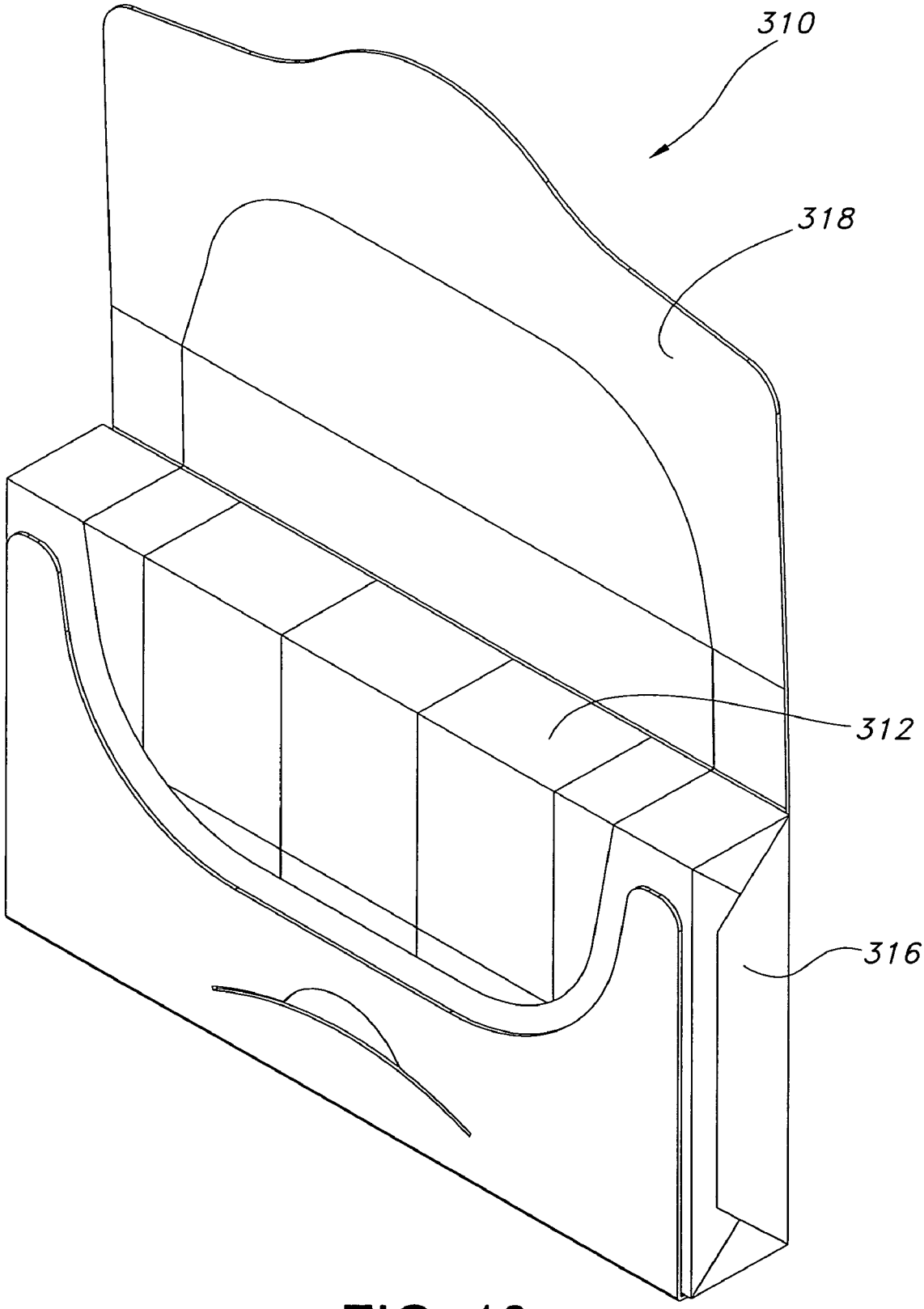
FIG. 13 shows a still further embodiment of reclosable package assembly of the present invention shown in the open condition.

A still further embodiment is shown with respect to FIG. 13. Package assembly 310is again substantially similar to the package assembly as described above. In the present illustrative embodiment, side-by-side products are arranged in two vertically stacked rows and define pillow-shaped gum pieces 312 having a rectangular front face. The packet 316 and the cover 318 are constructed to support such an arrangement. Again, in all other respects, the packet 316 and the cover 318 are constructed and operate in a manner similar to that described above with respect to the previous embodiment.

While the invention has been described in related to the preferred embodiments with several examples, it will be understood by those skilled in the art that various changes may be made without deviating from the fundamental nature and scope of the invention as defined in the appended claims.

What is claimed is:

1. A reclosable consumable product package assembly comprising:

a plurality of consumable products;

a container packet for retaining and enclosing products, said packet defining opposed major planar surfaces, opposed top and bottom surfaces, and opposed end surfaces; and a cover overlying said opposed major surfaces and said opposed top and bottom surfaces of said product and adhesively attached thereto;

said cover defining an openable flap overlying said top surface and at least a portion of one major surface;

said packet being scored along said one major surface and said top surface such that opening of said flap causes said packet to open along said scoring to expose said product for dispensing;

wherein said cover includes a front portion overlying said one major surface and wherein said flap overlies a portion of said front portion.

2. A reclosable package assembly of claim 1 wherein said flap is releasably secured to said front portion.

3. A reclosable package assembly of claim 1 wherein said packet is formed from a planar extent.

4. A reclosable package assembly of claim 3 wherein said extent is formed from foil wrap.

5. A reclosable package assembly of claim 3 wherein said extent is formed from combination of paper and foil wrap.

6. A reclosable package assembly of claim 1 wherein said scoring is laser scoring.

7. A reclosable package assembly of claim 1 wherein said cover is formed from paper.

8. A reclosable package assembly of claim 1 wherein said cover includes a slot to insert said flap thereby closing the package.

9. A reclosable consumable product package assembly comprising:

a plurality of consumable products;

a container packet for retaining and enclosing products, said packet defining opposed major planar surfaces, opposed top and bottom surfaces, and opposed end surfaces, and an adhesive applied inside the bottom surface of said packet said products being releasably adhere to the inside portion of the packet; and a cover overlying said opposed major surfaces and said opposed top and bottom surfaces of said product and adhesively attached thereto;

said cover defining an openable flap overlying said to surface and at least a portion of one major surface;

said packet being scored along said one major surface and said top surface such that opening of said flap causes said packet to open along said scoring to expose said product for dispensing.

10. A reclosable package assembly of claim 9 wherein the products directly contact the inside portion of the packet.

11. A reclosable package assembly of claim 9 wherein the products are individually contained in wrappers and the wrappers are releasably attached to the inner portion of the packet.

12. A reclosable package assembly of claim 1 wherein said cover includes a printed label.

13. A reclosable package assembly of claim 4 wherein said sheet is heat sealed to an inside portion of the cover.

14. A reclosable package assembly of claim 5 wherein said sheet is laser perforated with a smile cut shape scored on the paper part of the sheet.

15. A reclosable consumable product package assembly comprising:

a plurality of elongate gum slabs arranged in a face-to-face array;

a container packet for retaining and enclosing products, said packet defining opposed major planar surfaces, opposed top and bottom surfaces, and opposed end surfaces; and a cover overlying said opposed major surfaces and said opposed top and bottom surfaces of said product and adhesively attached thereto;

said cover defining an openable flap overlying said top surface and at least a portion of one major surface;

said packet being scored along said one major surface and said top surface such that opening of said flap causes said packet to open along said scoring to expose said product for dispensing

16. A reclosable consumable product package assembly comprising;

a plurality of pillow shaped gum pieces;

a container packet for retaining and enclosing products, said packet defining opposed major planar surfaces, opposed top and bottom surfaces, and opposed end surfaces; and a cover overlying said opposed major surfaces and said opposed too and bottom surfaces of said product and adhesively attached thereto;

said cover defining an openable flap overlying said top surface and at least a portion of one major surface;

said packet being scored along said one major surface and said to surface such that opening of said flap causes said packet to open along said scoring to expose said products for dispensing.

17. A reclosable package assembly of claim 16 wherein said gum pieces are arranged in two vertically stacked rows.

18. A reclosable package assembly of claim 17 wherein said gum pieces have a rectangular front face.

19. A reclosable package assembly of claim 17 wherein said gum pieces have a square front face.

20. A reclosable package assembly of claim 16 wherein said pillow shaped gum pieces are arranged in side-by-side array.

* * * * *

UNITED STATES PATENT AND TRADEMARK OFFICE

CERTIFICATE OF CORRECTION

PATENT NO. : 7,533,773 B2
APPLICATION NO. : 11/175014
DATED : May 19, 2009
INVENTOR(S) : Aldridge et al.

It is certified that error appears in the above-identified patent and that said Letters Patent is hereby corrected as shown below:

At column 1, line 32, the printed patent reads "...allows the adjacent gum slabs become..."; the patent should read instead as --...allows the adjacent gum slabs to become...--.

At column 3, line 26, the printed patent reads "...each of the gun slabs..."; the patent should read instead as --...each of the gum slabs...--.

At column 3, line 65, the printed patent reads "...assembly 310is again..."; the patent should read instead as --...assembly 310 is again...--.

At column 7, claim 16, line 4, the printed patent incorrectly reads "...said to surface such that..."; the patent should read --...said top surface such that...--.

Signed and Sealed this

Seventh Day of July, 2009

John Doll

JOHN DOLL
*Acting Director of the United States Patent and Trademark Office*